US011487226B1

(12) United States Patent
Sugiura et al.

(10) Patent No.: US 11,487,226 B1
(45) Date of Patent: Nov. 1, 2022

(54) IMAGE FORMING APPARATUS AND INTERMEDIATE TRANSFER UNIT CAPABLE OF MAINTAINING A TRANSFER PERFORMANCE OF AN INTERMEDIATE TRANSFER BODY

(71) Applicant: FUJIFILM Business Innovation Corp., Tokyo (JP)

(72) Inventors: Satoya Sugiura, Kanagawa (JP); Masato Ono, Kanagawa (JP); Shogo Hayashi, Kanagawa (JP); Daisuke Tanemura, Kanagawa (JP); Masayuki Seko, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/468,867

(22) Filed: Sep. 8, 2021

(30) Foreign Application Priority Data

May 18, 2021 (JP) ..... JP2021-084124

(51) Int. Cl.
*G03G 15/16* (2006.01)
*G03G 21/00* (2006.01)

(52) U.S. Cl.
CPC ..... *G03G 15/161* (2013.01); *G03G 15/162* (2013.01); *G03G 21/0017* (2013.01); *G03G 21/0064* (2013.01); *G03G 2221/0005* (2013.01)

(58) Field of Classification Search
CPC . G03G 15/161; G03G 15/162; G03G 21/0017
USPC ..... 399/101, 302
See application file for complete search history.

(56) References Cited

U.S. PATENT DOCUMENTS 9,442,430 B2 * 9/2016 Hamana et al. ... G03G 15/1685
10,036,991 B2 7/2018 Tanaka

FOREIGN PATENT DOCUMENTS

JP 2013-231964 A 11/2013
JP 2015-028614 A 2/2015
JP 2018-072468 A 5/2018
JP 2019-061151 A 4/2019

* cited by examiner

*Primary Examiner* — William J Royer
(74) *Attorney, Agent, or Firm* — Sughrue Mion, PLLC

(57) ABSTRACT

An image forming apparatus includes a photosensitive member, an intermediate transfer body including a surface layer that includes an acrylic resin and a fluorine-containing polyether, first and second transfer units, and an intermediate transfer body cleaning unit that includes a cleaning blade including a tetrahedral amorphous carbon layer disposed on a surface of a contact portion of the cleaning blade, the contact portion being arranged to contact the intermediate transfer body, and removes a residual toner by bringing the cleaning blade into contact with the intermediate transfer body. Linear velocities of the intermediate transfer body and the photosensitive member are adjusted to satisfy a requirement (1): Requirement (1): 0.3≤|Linear velocity of Intermediate transfer body−Linear velocity of Photosensitive member|/Linear velocity of Intermediate transfer body×100≤1.5.

20 Claims, 3 Drawing Sheets

IMAGE FORMING APPARATUS AND INTERMEDIATE TRANSFER UNIT CAPABLE OF MAINTAINING A TRANSFER PERFORMANCE OF AN INTERMEDIATE TRANSFER BODY

CROSS-REFERENCE TO RELATED APPLICATIONS

This application is based on and claims priority under 35 USC 119 from Japanese Patent Application No. 2021-084124 filed May 18, 2021.

BACKGROUND

(i) Technical Field

The present disclosure provides an image forming apparatus and an intermediate transfer unit.

(ii) Related Art

Japanese Laid Open Patent Application Publication No. 2013-231964 discloses an electrophotographic intermediate transfer body that includes a base layer and a surface layer, the surface layer having a matrix-domain structure extending in the thickness direction. The matrix includes a binder resin. The domain includes a perfluoropolyether. The microhardness of the electrophotographic intermediate transfer body measured with an ultra-microhardness meter is 50 MPa or more.

Japanese Laid Open Patent Application Publication No. 2015-028614 discloses an electrophotographic intermediate transfer body that includes a base layer and a surface layer, the surface layer including a binder resin and a perfluoropolyether. The amount of perfluoropolyether extracted from the intermediate transfer body when the intermediate transfer body is immersed, at 25° C. for 24 hours, in a solvent prepared by mixing 1,1,2,2,3,3,4-heptafluorocyclopentane and methyl ethyl ketone at a mass ratio of 1:1 is 0.10 mg or more and 5.00 mg or less per 10 $mm^3$ of the surface layer.

Japanese Laid Open Patent Application Publication No. 2018-072468 discloses a cleaning blade that includes a plate-like resin support and a coating layer covering at least one side of the resin support. The coating layer includes a joint layer including diamond-like carbon and at least one selected from the group consisting of titanium nitride, silicon titanium, tungsten titanium, titanium carbide, and titanium carbonitride and a surface layer that covers the joint layer and is composed of diamond-like carbon.

Japanese Laid Open Patent Application Publication No. 2019-061151 discloses a cleaning blade that includes a tetrahedral amorphous carbon-treated layer disposed at both ends of a contact surface of the cleaning blade, the contact surface being arranged to contact with a member that is to be cleaned, in the longitudinal direction of the cleaning blade.

SUMMARY

Aspects of non-limiting embodiments of the present disclosure relate to an image forming apparatus that may maintain the transfer performance of an intermediate transfer body in a suitable manner, compared with an image forming apparatus such that the linear velocities of an intermediate transfer body and a photosensitive member do not satisfy the requirement (1) or an image forming apparatus such that the linear velocities of an intermediate transfer body and a second transfer unit do not satisfy the requirement (2).

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a photosensitive member; a charging unit that charges a surface of the photosensitive member; an electrostatic image formation unit that forms an electrostatic image on the charged surface of the photosensitive member; a developing unit that includes a developer including a toner and develops the electrostatic image formed on the surface of the photosensitive member with the developer to form a toner image; an intermediate transfer body including a surface layer, the surface layer including an acrylic resin and a fluorine-containing polyether; a first transfer unit that transfers the toner image onto a surface of the intermediate transfer body as first transfer; a second transfer unit that transfers the toner image transferred on the surface of the intermediate transfer body to a recording medium as second transfer; and an intermediate transfer body cleaning unit that includes a cleaning blade including a tetrahedral amorphous carbon layer disposed on a surface of a contact portion of the cleaning blade, the contact portion being arranged to contact with the intermediate transfer body, and removes a residual toner by bringing the cleaning blade into contact with the intermediate transfer body, wherein linear velocities of the intermediate transfer body and the photosensitive member are adjusted to satisfy a requirement (1) below.

$$0.3 \leq |\text{Linear velocity of Intermediate transfer body} - \text{Linear velocity of Photosensitive member}| / \text{Linear velocity of Intermediate transfer body} \times 100 \leq 1.5 \quad \text{Requirement (1):}$$

BRIEF DESCRIPTION OF THE DRAWINGS

Exemplary embodiments of the present disclosure will be described in detail based on the following figures, wherein.

DETAILED DESCRIPTION

Figure 1:
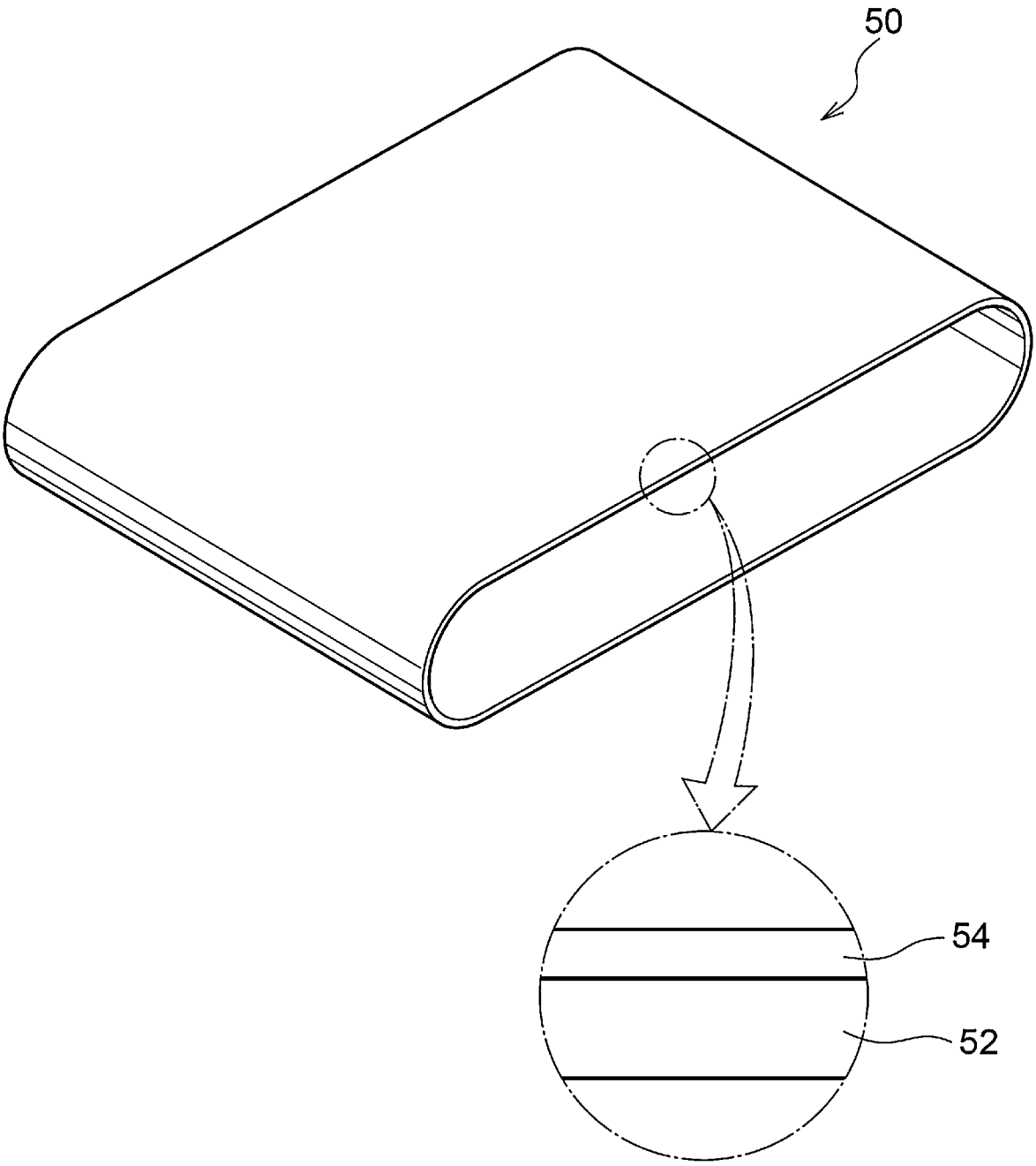
FIG. 1 is a schematic perspective view of an example of an intermediate transfer body included in an image forming apparatus according to an exemplary embodiment.

Exemplary embodiments of the present disclosure are described below. The following description and Examples below are intended to be illustrative of the exemplary embodiments and not restrictive of the scope of the exemplary embodiments.

In the present disclosure, when numerical ranges are described in a stepwise manner, the upper or lower limit of a numerical range may be replaced with the upper or lower limit of another numerical range, respectively. In the present disclosure, the upper and lower limits of a numerical range may be replaced with the upper and lower limits described in Examples below.

The term "step" used herein refers not only to an individual step but also to a step that is not distinguishable from other steps but achieves the intended purpose of the step.

In the present disclosure, when an exemplary embodiment is described with reference to a drawing, the structure of the exemplary embodiment is not limited to the structure illustrated in the drawing. The sizes of the members illustrated in the attached drawings are conceptual and do not limit the relative relationship among the sizes of the members.

Each of the components described in the present disclosure may include plural types of substances that correspond to the component. In the present disclosure, in the case where a composition includes plural types of substances that correspond to a component of the composition, the content of the component in the composition is the total content of the substances in the composition unless otherwise specified.

Image Forming Apparatus and Image Forming Method

An image forming apparatus according to an exemplary embodiment includes a photosensitive member; a charging unit that charges a surface of the photosensitive member; an electrostatic image formation unit that forms an electrostatic image on the charged surface of the photosensitive member; a developing unit that includes a developer including a toner and develops the electrostatic image formed on the surface of the photosensitive member with the developer to form a toner image; an intermediate transfer body; a first transfer unit that transfers the toner image onto a surface of the intermediate transfer body as first transfer; a second transfer unit that transfers the toner image transferred on the surface of the intermediate transfer body to a recording medium as second transfer; and an intermediate transfer body cleaning unit that removes a residual toner by bringing a cleaning blade into contact with the intermediate transfer body.

In the image forming apparatus according to this exemplary embodiment, the intermediate transfer body is an intermediate transfer body including a surface layer including an acrylic resin and a fluorine-containing polyether.

In the image forming apparatus according to this exemplary embodiment, the intermediate transfer body cleaning unit is an intermediate transfer body cleaning unit that includes a cleaning blade including a tetrahedral amorphous carbon layer disposed on a surface of a contact portion of the cleaning blade, the contact portion being arranged to contact with the intermediate transfer body, and removes a residual toner by bringing the cleaning blade into contact with the intermediate transfer body.

With the image forming apparatus according to this exemplary embodiment, an image forming method (an image forming method according to this exemplary embodiment) that includes a charging step of charging a surface of a photosensitive member; an electrostatic image formation step of forming an electrostatic image on the charged surface of the photosensitive member; a developing step of developing the electrostatic image formed on the surface of the photosensitive member with a developer including a toner to form a toner image; a first transfer step of transferring the toner image onto a surface of an intermediate transfer body as first transfer; a second transfer step of transferring the toner image transferred on the surface of the intermediate transfer body to a recording medium as second transfer; and an intermediate transfer body cleaning step of removing a residual toner by bringing a cleaning blade into contact with the intermediate transfer body may be implemented.

The image forming apparatus according to this exemplary embodiment may further include, for example, a fixing unit that fixes the toner image transferred on the surface of the recording medium; a photosensitive member cleaning unit that cleans the surface of the photosensitive member which has not yet been charged subsequent to the transfer of the toner image; and an erasing unit that irradiates, with erasing light, the surface of the photosensitive member which has not yet been charged subsequent to the transfer of the toner image in order to erase charge. A portion of the image forming apparatus according to this exemplary embodiment which includes the developing unit may be a cartridge structure (i.e., process cartridge) detachably attachable to the image forming apparatus.

The present disclosure provides first and second exemplary embodiments that relate to an image forming apparatus and an image forming method. Hereinafter, when the items common to the first and second exemplary embodiments are described, the first and second exemplary embodiments are referred to simply as "this exemplary embodiment".

In the first exemplary embodiment, the linear velocities of the intermediate transfer body and the photosensitive member are adjusted to satisfy the requirement (1) below. Either the linear velocity of the intermediate transfer body or the linear velocity of the photosensitive member may be higher.

$$0.3 \leq |\text{Linear velocity of Intermediate transfer body} - \text{Linear velocity of Photosensitive member}| / \text{Linear velocity of Intermediate transfer body} \times 100 \leq 1.5 \quad \text{Requirement (1):}$$

In first exemplary embodiment, in the case where a plurality of photosensitive members are present, the linear velocities of the intermediate transfer body and each of the photosensitive members are adjusted to satisfy the requirement (1).

In the second exemplary embodiment, the linear velocities of the intermediate transfer body and a second transfer unit are adjusted to satisfy the requirement (2) below. Either the linear velocity of the intermediate transfer body or the linear velocity of the second transfer unit may be higher.

$$0.3 \leq |\text{Linear velocity of Intermediate transfer body} - \text{Linear velocity of Second transfer unit}| / \text{Linear velocity of Intermediate transfer body} \times 100 \leq 1.5 \quad \text{Requirement (2):}$$

The term "linear velocity" used in this exemplary embodiment refers to the travel speed of the outer periphery of a rotary member and is expressed in millimeters per second.

The linear velocity of the photosensitive member may be 20 mm/sec or more and 800 mm/sec or less.

The linear velocity of the intermediate transfer body may be 20 mm/sec or more and 800 mm/sec or less.

The linear velocity of the second transfer unit may be 20 mm/sec or more and 800 mm/sec or less.

Hereinafter, "|Linear velocity of Intermediate transfer body−Linear velocity of Photosensitive member|/Linear velocity of Intermediate transfer body×100" is referred to as Formula (1), and "|Linear velocity of Intermediate transfer body−Linear velocity of Second transfer unit|/Linear velocity of Intermediate transfer body×100" is referred to as Formula (2).

An intermediate transfer body that includes a surface layer including a perfluoropolyether is known as an intermediate transfer body that may reduce the adhesion of a toner. The above intermediate transfer body maintains resistance to the adhesion of a toner as a result of the surface layer gradually becoming worn with use.

In general, the degree of wearing of the intermediate transfer body may vary between a portion of the intermediate transfer body on which an image is formed and the other portion on which an image is not formed, and between the center and edges of the intermediate transfer body in the width direction (i.e., a direction orthogonal to the rotating direction). The above phenomenon becomes significant particularly in the case where a rubber blade that does not include a surface layer is used as a cleaning blade for the intermediate transfer body. The inconsistencies in the degree of wearing of the outer peripheral surface of the intermediate transfer body result in inconsistencies in the transfer performance from the intermediate transfer body to a recording medium.

In order to address the above issue, an image forming apparatus according to this exemplary embodiment includes an intermediate transfer body including a surface layer including a perfluoropolyether and a cleaning blade for the intermediate transfer body which includes a tetrahedral amorphous carbon layer disposed on the surface of the cleaning blade, wherein the linear velocities of the intermediate transfer body and the photosensitive member are adjusted to satisfy the requirement (1) or the linear velocities of the intermediate transfer body and the second transfer unit are adjusted to satisfy the requirement (2). This may reduce the inconsistencies in the transfer performance of the intermediate transfer body and consequently enables transfer performance to be maintained in a suitable manner over a long period of time.

The requirement (1) means that there is an adequate difference between the linear velocities of the intermediate transfer body and the photosensitive member.

If the value of Formula (1) is less than 0.3, it becomes difficult to remove discharge products adhered on the surface of the intermediate transfer body and, consequently, the inconsistencies in the transfer performance of the intermediate transfer body may occur when the intermediate transfer body is used over a long period of time.

If the value of Formula (1) is more than 1.5, it becomes difficult to compensate for elongation of an image on the intermediate transfer body which may occur due to the difference in linear velocity and, consequently, the inconsistencies in the transfer performance of the intermediate transfer body may occur when the intermediate transfer body is used over a long period of time.

The requirement (2) means that there is an adequate difference between the linear velocities of the intermediate transfer body and the second transfer unit.

If the value of Formula (2) is less than 0.3, it becomes difficult to remove discharge products adhered on the surface of the intermediate transfer body and, consequently, the inconsistencies in the transfer performance of the intermediate transfer body may occur when the intermediate transfer body is used over a long period of time.

If the value of Formula (2) is more than 1.5, it becomes difficult to compensate for elongation of an image on the intermediate transfer body which may occur due to the difference in linear velocity and, consequently, the inconsistencies in the transfer performance of the intermediate transfer body may occur when the intermediate transfer body is used over a long period of time.

In the first exemplary embodiment, although the relationship between the linear velocities of the intermediate transfer body and the second transfer unit is not limited, the linear velocities of the intermediate transfer body and the second transfer unit may be adjusted to satisfy the requirement (2).

In the second exemplary embodiment, although the relationship between the linear velocities of the intermediate transfer body and the photosensitive member is not limited, the linear velocities of the intermediate transfer body and the photosensitive member may be adjusted to satisfy the requirement (1).

In this exemplary embodiment, the requirement (1) may be the requirement (1') below.

$$0.5 \leq |\text{Linear velocity of Intermediate transfer body} - \text{Linear velocity of Photosensitive member}| / \text{Linear velocity of Intermediate transfer body} \times 100 \leq 1.2 \quad \text{Requirement (1')}:$$

In this exemplary embodiment, in the case where a plurality of photosensitive members are present, each of the photosensitive members may satisfy the requirement (1').

In this exemplary embodiment, the requirement (2) may be the requirement (2') below.

$$0.5 \leq |\text{Linear velocity of Intermediate transfer body} - \text{Linear velocity of Second transfer unit}| / \text{Linear velocity of Intermediate transfer body} \times 100 \leq 1.2 \quad \text{Requirement (2')}:$$

In the first exemplary embodiment, the image forming apparatus includes a controller that controls the linear velocities of the intermediate transfer body and the photosensitive member. The controller may also be a controller that controls the linear velocity of the second transfer unit.

In the second exemplary embodiment, the image forming apparatus includes a controller that controls the linear velocities of the intermediate transfer body and the second transfer unit. The controller may also be a controller that controls the linear velocity of the photosensitive member.

Details of the intermediate transfer body and the intermediate transfer body cleaning unit included in the image forming apparatus according to this exemplary embodiment are described below.

Intermediate Transfer Body

FIG. 1 is a schematic perspective view of an example of an intermediate transfer body 50. The intermediate transfer body 50 illustrated in FIG. 1 is an endless belt-like member. The intermediate transfer body 50 is not limited to this and may be roller-like.

The intermediate transfer body 50 illustrated in FIG. 1 includes a base layer 52 and a surface layer 54. The surface layer 54 is a layer constituting the outer peripheral surface of the intermediate transfer body 50.

The volume resistivity of the intermediate transfer body 50 may be $1.0\times10^{7}$ Ω·cm or more and $1.0\times10^{12}$ Ω·cm or less.

In this exemplary embodiment, volume resistivity (log Ω·cm) is measured in the following manner.

The measurement is conducted at a temperature of 22° C. and a relative humidity of 55%. The sample is placed in the above measurement environment for 24 hours or more to perform air conditioning. The resistance meter used is a micro current meter "R8430A" produced by Advantest Corporation. The probe used is a UR probe produced by Mitsubishi Chemical Corporation. In the measurement, a voltage of 1 kV is applied to the intermediate transfer body 50 for 5 seconds. The load is set to 1 kgf. The measurement is conducted at the center and both ends (i.e., 3 positions) of the intermediate transfer body 50 in the width direction, for each of 6 positions spaced at regular intervals in the circumferential direction of the intermediate transfer body 50, that is, 18 positions in total. The arithmetic average of resistance values measured at the above 18 positions is calculated.

The microhardness of the intermediate transfer body 50 which is measured with an ultra-microhardness meter at the surface is preferably 50 MPa or more, is more preferably 80 MPa or more, and is further preferably 100 MPa or more. Microhardness is measured using an ultra-microhardness meter "ENT-1100" produced by Elionix Inc. and a triangular diamond indenter having a dihedral angle of 115° at a load of 50 mg.

The base layer 52 may be a semiconductive film or sheet including a resin and a conductant agent.

Examples of the resin include a polyamide, a polyimide, a polyamide imide, a polyether imide, a polyether ether ketone, a polyphenylene sulfide, a polyethersulfone, a polyphenylsulfone, a polysulfone, a polyethylene terephthalate, a polybutylene terephthalate, a polyacetal, a polycarbonate, and a polyester. A polyimide, a polyamide imide, and a polyether ether ketone may be used in consideration of the strength and durability of the base layer. The above resins may be used alone or in combination of two or more.

Examples of the conductant agent include carbon black materials, such as Ketjenblack, oil furnace black, channel black, and acetylene black; metals, such as aluminum and nickel; metal oxides, such as indium tin oxide, tin oxide, titanium oxide, and yttrium oxide; ionic conductive substances, such as potassium titanate, potassium chloride, sodium perchlorate, and lithium perchlorate; and ionic conductive polymers, such as polyaniline, polyether, polypyrrole, polysulfone, and polyacetylene. The above conductant agents may be used alone or in combination of two or more.

Carbon black may be used as a conductant agent included in the base layer 52. The average primary particle size of carbon black used as a conductant agent may be 10 nm or more and 40 nm or less.

The content of the conductant agent varies by the type of the conductant agent used. In the case where carbon black is used as a conductant agent, the content of the conductant agent may be 5 parts by mass or more and 40 parts by mass or less relative to 100 parts by mass of the resin.

The volume resistivity of the base layer 52 may be $1.0\times10^{7}$ Ω·cm or more and $1.0\times10^{12}$ Ω·cm or less.

The base layer 52 may include additives, such as an antioxidant, a crosslinking agent, a flame retardant, a colorant, a surfactant, a dispersant, and a filler.

The thickness of the base layer 52 may be 30 μm or more and 150 μm or less.

The surface layer 54 includes an acrylic resin and a fluorine-containing polyether. The term "acrylic resin" used herein refers to a resin such that 50 mol % or more of polymerization constituents of the resin is one or more selected from acrylates and methacrylates.

Examples of the monomer constituting the acrylic resin include the following acrylates and methacrylates:

(i) at least one acrylate selected from the group consisting of pentaerythritol triacrylate, pentaerythritol tetraacrylate, ditrimethylolpropane tetraacrylate, dipentaerythritol hexaacrylate, alkyl acrylate, benzyl acrylate, phenyl acrylate, ethylene glycol diacrylate, and bisphenol A diacrylate; and (ii) at least one methacrylate selected from the group consisting of pentaerythritol trimethacrylate, pentaerythritol tetramethacrylate, ditrimethylolpropane tetramethacrylate, dipentaerythritol hexamethacrylate, alkyl methacrylate, benzyl methacrylate, phenyl methacrylate, ethylene glycol dimethacrylate, and bisphenol A dimethacrylate.

The fluorine-containing polyether is an oligomer or polymer including, for example, an alkylene ether, such as a methylene ether, an ethylene ether, or a propylene ether, as a repeating unit, wherein hydrogen atoms are replaced with fluorine atoms.

The fluorine-containing polyether may be a perfluoropolyether. A perfluoropolyether is an oligomer or polymer that includes a perfluoroalkylene ether as a repeating unit. Examples of the perfluoroalkylene ether include perfluoromethylene ether, perfluoroethylene ether, and perfluoropropylene ether. Specific examples thereof include "DEMNUM" produced by Daikin Industries, Ltd., "Krytox" produced by Du Pont, and "Fomblin" produced by Solvay Solexis.

The perfluoropolyether may be an oligomer or polymer that includes at least one of a repeating unit 1: —O—$CF_2$—$CF_2$— and a repeating unit 2: —O—$CF_2$—. The number of repetition of the repeating unit 1 and the number of repetition of the repeating unit 2 may be each independently 0 or more and 100 or less. In the case where the perfluoropolyether includes both repeating units 1 and 2, the perfluoropolyether may be a block copolymer or a random copolymer.

The perfluoropolyether may be a molecule that includes a reactive functional group that combines with the acrylic resin in the surface layer 54 to form a bond or a state analogous to a bond or a unreactive functional group that does not combine with the acrylic resin in the surface layer 54 to form a bond or a state analogous to a bond.

Examples of the reactive functional group include an acryl group, a methacryl group, and an oxiranyl group. Examples of a perfluoropolyether including the above reactive functional group include Fluorolink MD500, Fluorolink MD700, Fluorolink 5101X, Fluorolink 5113X, Fluorolink AD1700, and Fluorolink S10 produced by Solvay Solexis; and Optool DAC produced by Daikin Industries, Ltd.

Examples of the unreactive functional group include a hydroxyl group, a trifluoromethyl group, and a methyl group. Examples of a perfluoropolyether including the above unreactive functional group include Fluorolink D10H, Fluorolink D4000, and Fomblin Z15 produced by Solvay Solexis; and DEMNUM S-20, DEMNUM S-65, and DEMNUM S-200 produced by Daikin Industries, Ltd.

The weight average molecular weight of the perfluoropolyether is preferably 100 or more and 9,000 or less and is more preferably 100 or more and 8,000 or less.

The content of the fluorine-containing polyether in the surface layer 54 is preferably 5% by mass or more and 70% by mass or less, is more preferably 10% by mass or more and 60% by mass or less, and is further preferably 20% by mass or more and 50% by mass or less of the total mass of the surface layer 54.

The content of the perfluoropolyether in the surface layer 54 is preferably 10% by mass or more and 70% by mass or less, is more preferably 15% by mass or more and 60% by mass or less, and is further preferably 20% by mass or more and 50% by mass or less of the total mass of the surface layer 54.

The surface layer 54 may include a dispersant for dispersing the perfluoropolyether. The dispersant may be a compound that includes a site having an affinity for a perfluoroalkyl chain and a hydrocarbon, that is, an amphipathic surfactant, block copolymer, or graft copolymer which is both compatible and incompatible with fluorine. The dispersant may include at least one of the copolymers (a) and (b) below.

(a) a block copolymer produced by copolymerization of a vinyl monomer including a fluoroalkyl group with an acrylate or methacrylate. Specific examples thereof include MODIPER F200, F210, F2020, F600, and FT-600 produced by NOF Corporation.

(b) a comb-shaped graft copolymer produced by copolymerization of an acrylate or methacrylate including a fluoroalkyl group with a methacrylate macromonomer having a side chain including polymethyl methacrylate. Specific examples thereof include Aron GF-150, GF-300, and GF-400 produced by Toagosei Co., Ltd.

The content of the dispersant in the surface layer 54 is preferably 1% by mass or more and 70% by mass or less and is more preferably 5% by mass or more and 60% by mass or less of the total mass of the surface layer 54.

The surface layer 54 may include a resin other than the acrylic resin. Examples of the other resin include a styrene resin, an epoxy resin, a polyester resin, a polyether resin, a silicone resin, and a polyvinyl butyral resin. The other resins above may be used alone or in combination of two or more.

The surface layer 54 may include a conductant agent. Examples of the conductant agent include metal oxides, such as tin oxide, indium tin oxide, titanium oxide, and yttrium oxide; carbon black materials, such as Ketjenblack, oil furnace black, channel black, and acetylene black; metals, such as aluminum and nickel; ionic conductive substances, such as potassium titanate, potassium chloride, sodium perchlorate, and lithium perchlorate; and ionic conductive polymers, such as polyaniline, polyether, polypyrrole, polysulfone, and polyacetylene. The above conductant agents may be used alone or in combination of two or more.

The conductant agent included in the surface layer 54 may be a metal oxide, such as tin oxide, indium tin oxide, titanium oxide, or yttrium oxide. In the case where the conductant agent is a metal oxide, the content of the conductant agent may be 5 parts by mass or more and 30 parts by mass or less relative to 100 parts by mass of the resin.

The surface layer 54 may include an additive, such as an antioxidant, a crosslinking agent, a flame retardant, a colorant, or a filler.

The thickness of the surface layer 54 is preferably 1 μm or more and is more preferably 2 μm or more in consideration of the abrasion resistance of the surface layer 54. The thickness of the surface layer 54 is preferably 20 μm or less and is more preferably 10 μm or less in consideration of the flex resistance of the intermediate transfer body 50.

The surface layer 54 may include a sea-island structure. The sea-island structure of the surface layer 54 may include a sea phase including the acrylic resin and an island phase including the fluorine-containing polyether, such as the perfluoropolyether. In this exemplary embodiment, a continuous phase including the acrylic resin is the sea phase, while a disperse phase including the fluorine-containing polyether, such as the perfluoropolyether, is the island phase. In this exemplary embodiment, a structure including a sea phase, which is a continuous phase, and an island phase, which is a disperse phase, is referred to as "sea-island structure".

The average diameter of the island phase in a cross section of the surface layer 54 is preferably 30 nm or more and 3,000 nm or less and is more preferably 100 nm or more and 1,000 nm or less.

The area fraction of the island phase in a cross section of the surface layer 54 is preferably 1% or more and 50% or less and is more preferably 3% or more and 30% or less.

The determination of the sea-island structure and the measurement of the dimensions and area of the island phase are conducted by the following method.

(1) Taking Image of Cross Section of Surface Layer

The surface layer is cut in the thickness direction by the cryomicrotome method to prepare a slice sample of the surface layer. An image of the slice sample is taken with a scanning electron microscope.

(2) Distinguishing Sea Phase and Island Phase from Each Other

The sea and island phases included in the sea-island structure can be distinguished from each other by the color density. Whether the sea-island structure is present and whether the sea and island phases are present are determined on the basis of the color density.

(3) Average Diameter and Area Fraction of Island Phase

Within the image, 10 regions with sides of 4 micrometers are randomly selected. Thus, the total area of the observation regions is 160 $\mu m^2$. When the thickness of the surface layer is less than 4 μm, the number of the regions that are to be observed is increased such that the total area of the observation regions reaches 160 $\mu m^2$.

The length (μm) of the major axis of each of the island phase portions that are found in the observation regions is measured, and the arithmetic average thereof is considered as an average diameter (μm) of the island phase. The length of the major axis of an island phase portion is the length of the longest of the straight lines that connect any two points on the outline of the island phase portion to each other.

The area of each of the island phase portions that are found in the observation region is measured. The ratio of the total area of the island phase to the total area (i.e., 160 $\mu m^2$) of the surface layer is calculated and considered as the area fraction (%) of the island phase.

The intermediate transfer body 50 may include a layer other than the base layer 52 or the surface layer 54. The intermediate transfer body 50 may include, for example, a metal layer or a metal oxide layer interposed between the base layer 52 and the surface layer 54.

Examples of a method for producing the intermediate transfer body 50 include a production method including a first step of preparing a pipe-like member that serves as a base layer 52, and a second step of forming a surface layer 54 on the pipe-like member.

The pipe-like member prepared in the first step may be any of the following molded articles: an extrusion molded article produced by melting a resin composition including a resin and a conductant agent, extruding the molten resin composition into a belt-like shape through a die, and solidifying the belt-shaped resin composition; an injection molded article produced by melting a resin composition including a resin and a conductant agent, charging the molten resin composition into a belt-shaped mold, and solidifying the belt-shaped resin composition; and a coat molded article prepared by applying a liquid composition including a resin, a resin precursor, or monomer, and a conductant agent to a core and solidifying the resulting coating film.

Examples of the second step include a step of applying a liquid composition including the acrylic resin or monomer and the fluorine-containing polyether onto the outer peripheral surface of the pipe-like member and solidifying the resulting coating film; and a step of applying a liquid composition including the acrylic resin or monomer and the fluorine-containing polyether to a core, solidifying the resulting coating film to prepare a pipe-like film, and depositing the pipe-like film on the pipe-like member. In the solidification of the liquid composition, optionally, drying, heating, electron beam irradiation, or ultraviolet irradiation may be performed in accordance with the types of the constituents.

A polymerization initiator, a dispersant, a conductant agent, and the like may be optionally added to the liquid composition used for forming the surface layer 54.

Intermediate Transfer Body Cleaning Unit

The intermediate transfer body cleaning unit includes, for example, a housing, a cleaning blade, and a container that includes a collected toner. The intermediate transfer body cleaning unit may further include another member or mechanism.

Figure 2:
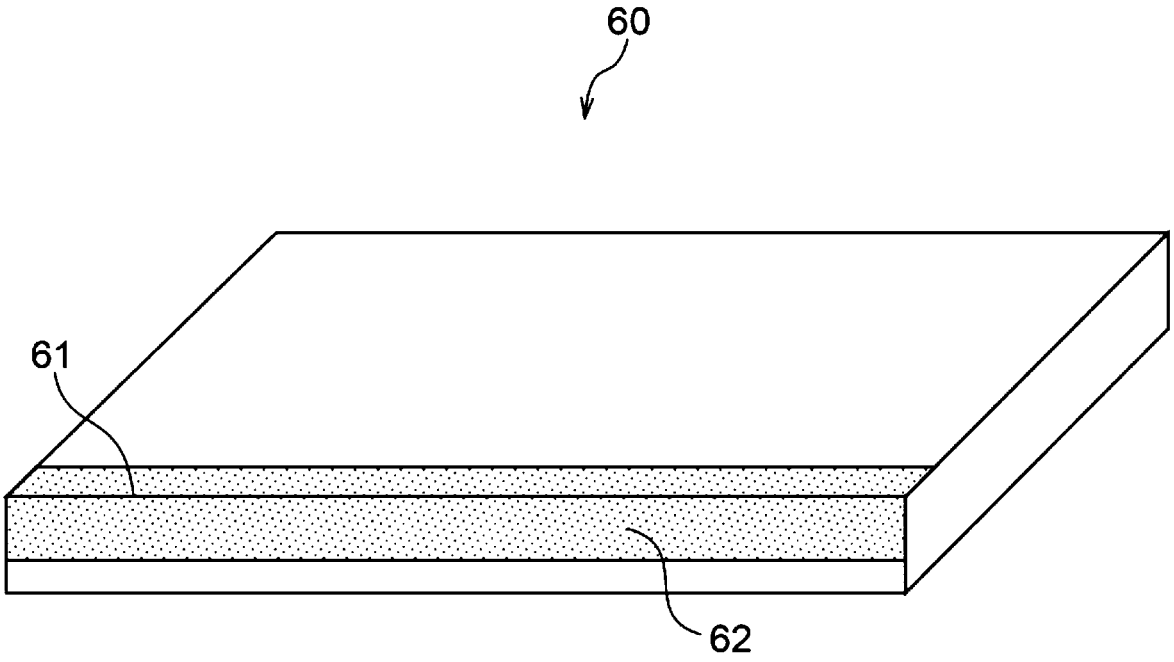
FIG. 2 is a schematic perspective view of an example of a cleaning blade included in the image forming apparatus according to the exemplary embodiment.

FIG. 2 is a schematic perspective view of an example of a cleaning blade 60 included in the intermediate transfer body cleaning unit. The cleaning blade 60 illustrated in FIG. 2 is a plate-like member. The cleaning blade 60 is joined to the housing of the intermediate transfer body cleaning unit with a metal shaft or the like interposed therebetween.

A long side 61 and its peripheral portion of the cleaning blade 60 constitute a contact portion that is to contact with the intermediate transfer body. A ta-C layer 62 is a tetrahedral amorphous carbon layer arranged to cover the long side 61 of the cleaning blade 60. That is, the ta-C layer 62 is present on the surface of the contact portion of the cleaning blade 60 which is to contact with the intermediate transfer body. The tetrahedral amorphous carbon layer may be further disposed on the surface of a portion of the cleaning blade 60 which does not contact with the intermediate transfer body.

The cleaning blade 60 includes an elastic member composed of a polyurethane rubber, a polyimide rubber, a silicone rubber, a fluorine rubber, a propylene rubber, a butadiene rubber, or the like as a support and the ta-C layer 62 disposed on a part of the surface of the elastic member.

The support of the cleaning blade 60 may be composed of a polyurethane rubber. A polyurethane rubber is commonly synthesized by polymerization of a polyisocyanate with a polyol. The polyurethane rubber may include hard and soft segments.

The thickness of the cleaning blade 60 may be 1 mm or more and 7 mm or less.

The thickness of the ta-C layer 62 is preferably 0.05 μm or more and 0.3 μm or less and is more preferably 0.1 μm or more and 0.2 μm or less.

The ta-C layer 62 is formed by chemical vapor deposition (CVD) or physical vapor deposition (PVD). Specifically, the ta-C layer 62 is formed by microwave plasma CVD, direct-current plasma CVD, high-frequency plasma CVD, effective magnetic field plasma CVD, ion beam sputtering, ion beam deposition, reactive plasma sputtering, unbalanced magnetron sputtering, or the like. Examples of the raw material gas used in the above deposition methods include hydrocarbon gases, such as methane, ethane, propane, ethylene, benzene, and acetylene; halogenated carbons, such as methylene chloride, carbon tetrachloride, chloroform, and trichloroethane; alcohols, such as methyl alcohol and ethyl alcohol; ketones, such as acetone and diphenyl ketone; carbon monoxide and carbon dioxide; and gases produced by mixing $N_2$, $H_2$, $O_2$, $H_2O$, Ar, or the like with the above carbon-containing gases. Among the above deposition methods, filtered cathodic vacuum arc (FCVA), which is an ion beam deposition method in which an arc plasma source is used, may be used for forming the ta-C layer 62.

The cleaning blade 60 may include a layer other than the ta-C layer 62. For example, a metal layer or a metal oxide layer may be interposed between the support and the ta-C layer 62 in order to enhance the fixability of the ta-C layer 62.

The contact pressure at which the cleaning blade 60 contacts with the intermediate transfer body may be 0.5 gf/mm or more and 5.0 gf/mm or less. The contact width of the cleaning blade 60 (i.e., the length of the portion of the cleaning blade 60 which contacts with the intermediate transfer body in the rotating direction) may be 5 μm or more and 100 μm or less. The contact angle of the cleaning blade 60 may be 5° or more and 30° or less.

The intermediate transfer body cleaning unit may include, as a cleaning member, a rotary brush including conductive fibers arranged in a cylindrical form in addition to the cleaning blade 60. The conductive fibers constituting the outer peripheral surface of the rotary brush contact with the outer peripheral surface of the intermediate transfer body to remove and collect a residual toner that remains on the outer peripheral surface of the intermediate transfer body.

The rotary brush includes the conductive fibers in order to reduce the accumulation of electric charge at the rotary brush. Examples of the conductive fibers included in the rotary brush include fibers composed of a conductive material, such as carbon fibers; and fibers produced by coating nonconductive fibers with a conductant agent, such as carbon black, a metal, a metal oxide, or a conductive resin, or kneading such a conductant agent into nonconductive fibers. Examples of the nonconductive fibers include a native cellulose fiber, a regenerated cellulose fiber such as rayon, a nylon fiber, a polypropylene fiber, a polyester fiber, a polyurethane fiber, a polyolefin fiber, an acrylic fiber, a polyamide fiber, a polyamide imide fiber, a polyether amide fiber, a polyphenylene sulfide fiber, a polybenzimidazole fiber, and a polyvinyl fiber.

The diameter of the conductive fibers included in the rotary brush may be 5 μm or more and 200 μm or less.

The outer peripheral surface of the rotary brush is constituted by the conductive fibers arranged in a cylindrical form. When the edges of the conductive fibers of the rotary brush are considered to form the outer peripheral surface of the rotary brush, the amount of toner retained on the outer peripheral surface of the rotary brush per unit area may be adjusted to be 1.0 $g/m^2$ or more and 4.0 $g/m^2$ or less during the operation of the image forming apparatus.

When the amount of toner retained on the outer peripheral surface of the rotary brush is 1.0 $g/m^2$ or more, a degraded layer present in the surface of the intermediate transfer body can be polished with the toner and an external additive and, consequently, the inconsistencies in the transfer performance of the intermediate transfer body may be reduced. From the above viewpoint, the amount of toner retained on the outer peripheral surface of the rotary brush is more preferably 1.5 $g/m^2$ or more and is further preferably 2.0 $g/m^2$ or more.

When the amount of toner retained on the outer peripheral surface of the rotary brush is 4.0 $g/m^2$ or less, the adhesion of the toner from the brush to the intermediate transfer body can be reduced and, consequently, the inconsistencies in the transfer performance of the intermediate transfer body may be reduced. From the above viewpoint, the amount of toner retained on the outer peripheral surface of the rotary brush is more preferably 3.5 $g/m^2$ or less and is further preferably 3.0 $g/m^2$ or less.

The amount of toner retained on the outer peripheral surface of the rotary brush is controlled by, for example, the amount of time during which the rotary brush contacts with the intermediate transfer body and the contact pressure at which the rotary brush contacts with the intermediate transfer body.

The image forming apparatus according to this exemplary embodiment may include a controller that controls the amount of toner retained on the outer peripheral surface of the rotary brush.

The length of bristles of the rotary brush including the conductive fibers arranged in a cylindrical form may be 2 mm or more and 10 mm or less.

The intermediate transfer body cleaning unit may include a feed mechanism that feeds a fatty acid metal salt onto the surface of the intermediate transfer body. The feed mechanism includes, for example, a solid fatty acid metal salt and a rotary brush arranged rotatably to contact with the solid fatty acid metal salt and the outer peripheral surface of the intermediate transfer body.

Examples of the fatty acid metal salt include salts of stearic acid with metals, such as calcium, barium, copper, aluminum, and magnesium; dibasic lead stearate; salts of oleic acid with metals, such as zinc, magnesium, iron, cobalt, copper, and calcium; salts of lauric acid with metals, such as zinc, calcium, magnesium, barium, and aluminum; salts of palmitic acid with metals, such as aluminum and calcium; and lead caprylate, lead caproate, zinc linoleate, cobalt linoleate, calcium ricinoleate, zinc ricinoleate, and cadmium ricinoleate. Among these, zinc stearate may be used.

The amount of the fatty acid metal salt (in particular, zinc stearate) fed onto the outer peripheral surface of the intermediate transfer body from the fatty acid metal salt feeding device per unit area may be 10 $\mu g/cm^2$ or more and 500 $\mu g/cm^2$ or less.

The intermediate transfer body and the intermediate transfer body cleaning unit constitute an intermediate transfer unit. That is, the intermediate transfer unit includes an intermediate transfer body including a surface layer, the surface layer including an acrylic resin and a fluorine-containing polyether, and an intermediate transfer body cleaning unit that includes a cleaning blade including a tetrahedral amorphous carbon layer disposed on the surface of a contact portion of the cleaning blade, the contact portion being arranged to contact with the intermediate transfer body, and removes a residual toner by bringing the cleaning blade into contact with the intermediate transfer body.

The structures of the intermediate transfer body and the intermediate transfer body cleaning unit included in the intermediate transfer unit are the same as described above.

An example of the image forming apparatus according to this exemplary embodiment is described below. The image forming apparatus is not limited thereto. Hereinafter, only components illustrated in drawings are described; others are omitted.

Figure 3:
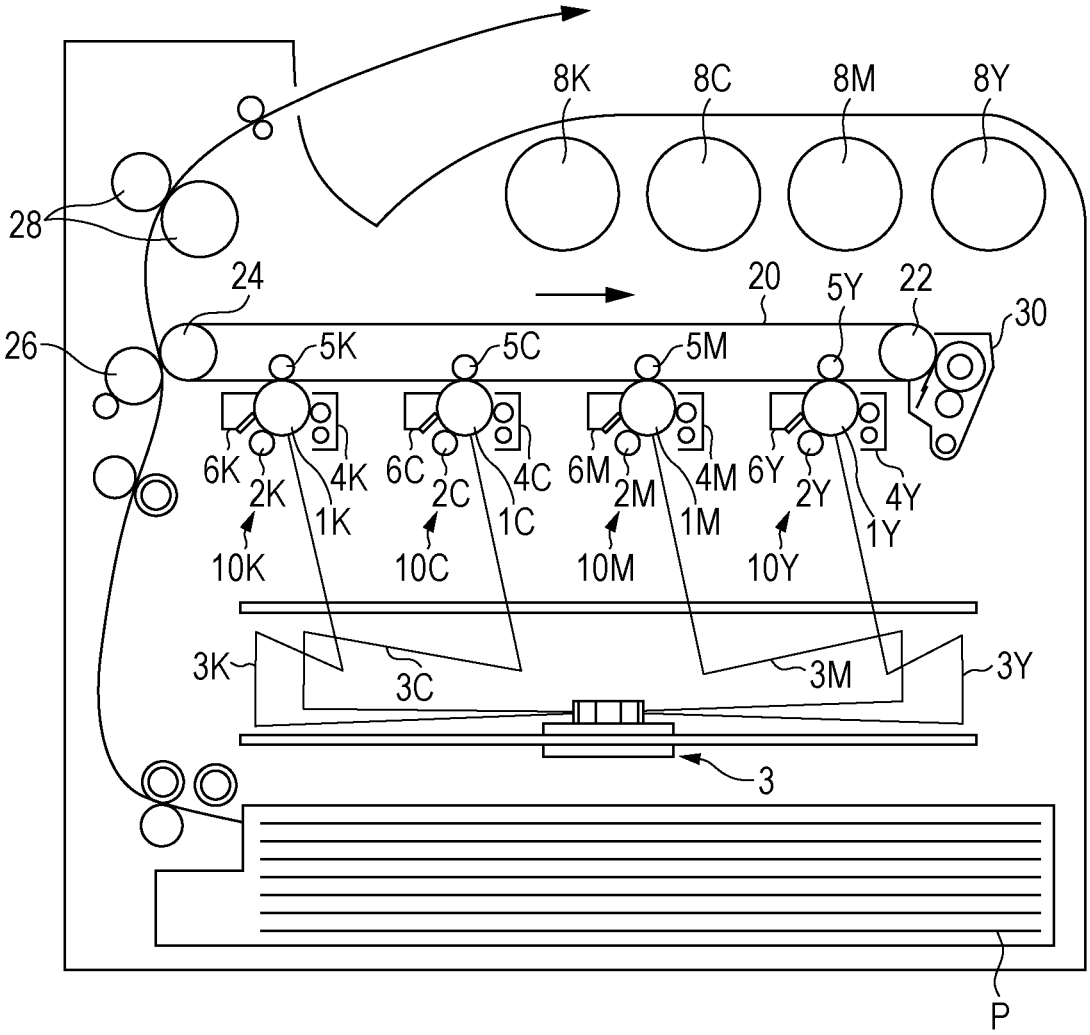
FIG. 3 is a schematic diagram illustrating an example of the image forming apparatus according to the exemplary embodiment.

FIG. 3 schematically illustrates the image forming apparatus according to this exemplary embodiment.

The image forming apparatus illustrated in FIG. 3 includes first to fourth electrophotographic image formation units 10Y, 10M, 10C, and 10K that form yellow (Y), magenta (M), cyan (C), and black (K) images, respectively, on the basis of color separation image data. The image formation units (hereinafter, referred to simply as "units") 10Y, 10M, 10C, and 10K are horizontally arranged in parallel at a predetermined distance from one another. The units 10Y, 10M, 10C, and 10K may be process cartridges detachably attachable to the image forming apparatus.

An intermediate transfer belt (example of the intermediate transfer body) 20 runs above and extends over the units 10Y, 10M, 10C, and 10K. The intermediate transfer belt 20 is wound around a drive roller 22 and a support roller 24, which are arranged to contact with the inner surface of the intermediate transfer belt 20, and runs clockwise in FIG. 3, that is, in the direction from the first unit 10Y to the fourth unit 10K. Using a spring or the like (not illustrated), a force is applied to the support roller 24 in a direction away from the drive roller 22, thereby applying tension to the intermediate transfer belt 20 wound around the drive roller 22 and the support roller 24. An intermediate transfer belt cleaning device (example of the intermediate transfer body cleaning unit) 30 is disposed so as to contact with the image holding surface of the intermediate transfer belt 20 and to face the drive roller 22.

The intermediate transfer belt cleaning device 30 includes a cleaning blade arranged to contact with the outer peripheral surface of the intermediate transfer belt 20. The cleaning blade contacts with the outer peripheral surface of the intermediate transfer belt 20 that keeps running after the transfer of a toner image to a recording medium to remove a residual toner that remains on the outer peripheral surface of the intermediate transfer belt 20.

Developing devices (examples of the developing units) 4Y, 4M, 4C, and 4K of the units 10Y, 10M, 10C, and 10K are supplied with yellow, magenta, cyan, and black toners stored in toner cartridges 8Y, 8M, 8C, and 8K, respectively.

Since the first to fourth units 10Y, 10M, 10C, and 10K have the same structure and the same action, the following description is made with reference to, as a representative, the first unit 10Y that forms an yellow image and is located upstream in a direction in which the intermediate transfer belt 20 runs.

The first unit 10Y includes a photosensitive member 1Y. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic image formation unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller (example of the first transfer unit) 5Y that transfers the developed toner image to the intermediate transfer belt 20; and a photosensitive member cleaning device 6Y that removes a toner remaining on the surface of the photosensitive member 1Y after the first transfer.

The first transfer roller 5Y is disposed inside of the intermediate transfer belt 20 so as to face the photosensitive member 1Y. Each of the first transfer rollers 5Y, 5M, 5C, and 5K of the respective units is connected to a bias power supply (not illustrated) that applies a first transfer bias to the first transfer rollers.

A second transfer roller (example of the second transfer unit) 26 is disposed outside of the intermediate transfer belt 20 so as to face the support roller 24 across the intermediate transfer belt 20. The second transfer roller 26 is connected to a bias power supply (not illustrated) that applies a second transfer bias to the second transfer roller 26.

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive support (e.g., volume resistivity at 20° C.: $1\times10^{-6}$ Ωcm or less). The photosensitive layer is normally of high resistance (comparable with the resistance of ordinary resins), but, upon being irradiated with the laser beam, the specific resistance of the portion irradiated with the laser beam varies. Thus, the exposure device 3 irradiates the charged surface of the photosensitive member 1Y with the laser beam 3Y on the basis of the image data of the yellow image sent from the controller (not illustrated). As a result, an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is developed and visualized in the form of a toner image by the developing device 4Y at the developing position.

The developing device 4Y includes an electrostatic image developer including, for example, at least, a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the erased latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, in the first unit 10Y, for example, +10 μA by a controller (not illustrated).

Each of the first transfer biases applied to first transfer rollers 5M, 5C, and 5K of the second, third, and fourth units 10M, 10C, and 10K is controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are stacked on top of another.

The intermediate transfer belt 20 on which toner images of four colors are multiple-transferred in the first to fourth units is then transported to a second transfer section formed by the intermediate transfer belt 20, the support roller 24, and the second transfer roller 26. A recording paper (example of the recording medium) P is fed by a feed mechanism into a narrow space between the second transfer roller 26 and the intermediate transfer belt 20 that contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not illustrated) that detects the resistance of the second transfer section and controlled by changing voltage.

The controller 40 controls the linear velocities of the photosensitive members 1Y, 1M, 1C, and 1K, the linear velocity of the intermediate transfer belt 20, and the linear velocity of the second transfer roller 26.

The controller 40 includes a central processing unit (CPU), a read only memory (ROM), a random access memory (RAM), a storage, and an input-output interface (I/O), which are not illustrated in the drawings. The above components are connected to one another via a bus so as to mutually communicate with one another.

The CPU executes various programs and controls various units. That is, the CPU reads a program from the ROM or the storage and executes the program using the RAM as a workspace. The CPU controls the above-described components and executes various types of processing in accordance with the programs stored in the ROM or the storage. The ROM stores various programs and data. The RAM temporarily retains programs or data as a workspace. The storage is constituted by a hard disk drive (HDD), a solid state drive (SSD), or a flash memory and stores various programs and data including an operating system.

After the toner image has been transferred to recording paper P, the intermediate transfer belt 20 keeps running and contacts with the cleaning blade included in the intermediate transfer belt cleaning device 30. The toner that remains on the intermediate transfer belt 20 is removed and collected by the intermediate transfer belt cleaning device 30.

The recording paper P, on which the toner image is transferred, is transported into a nip part of a fixing device (example of the fixing unit) 28 at which a pair of fixing rollers contact with each other. The toner image is fixed to the recording paper P to form a fixed image. The recording paper P, to which the color image has been fixed, is transported toward an exit portion. Thus, the series of the steps for forming a color image are terminated.

Examples of the recording paper P to which a toner image is transferred include plain paper used in electrophotographic copiers, printers, and the like. Instead of the recording paper P, OHP films and the like may be used as a recording medium.

Developer

The developer used in this exemplary embodiment may be a single-component developer including only a toner or may be a two-component developer that is a mixture of a toner and a carrier.

The toner includes, for example, toner particles and an external additive.

The toner particles include, for example, a binder resin, a colorant, a release agent, and other additives. The toner particles may have a single-layer structure or a "core-shell" structure constituted by a core (i.e., core particle) and a coating layer (i.e., shell layer) covering the core.

Examples of the external additive include particles of a metal oxide, such as silica, titania, or alumina. The surfaces of the external additive particles may be subjected to a hydrophobic treatment.

The volume average particle size of the toner is preferably 7.0 μm or less, is more preferably 6.5 μm or less, and is further preferably 5.8 μm or less in order to form a high-definition image. The volume average particle size of the toner is preferably 2.0 μm or more, is more preferably 3.0 μm or more, and is further preferably 4.0 μm or more in order to reduce the aggregation of toner particles.

The smaller the particle size of the toner, the higher the occurrence of inconsistencies in the transfer performance from the intermediate transfer body to a recording medium. However, the image forming apparatus according to this exemplary embodiment may reduce the inconsistencies in the transfer performance of the intermediate transfer body even in the case where a toner having a relatively small volume average particle size (e.g., a toner having a volume average particle size of 7.0 μm or less) is used.

The volume average particle size of the toner is measured using "COULTER MULTISIZER II" produced by Beckman Coulter, Inc. with an electrolyte "ISOTON-II" produced by Beckman Coulter, Inc. in the following manner. A sample to be measured (0.5 mg or more and 50 mg or less) is added to 2 ml of a 5 mass %-aqueous solution of a surfactant (e.g., sodium alkylbenzene sulfonate) that serves as a dispersant. The resulting mixture is added to 100 ml or more and 150 ml or less of an electrolyte. The resulting electrolyte solution containing the sample suspended therein is subjected to a dispersion treatment for 1 minute using an ultrasonic disperser, and the distribution of the diameters of particles having a diameter of 2 μm or more and 60 μm or less is measured using COULTER MULTISIZER II with an aperture having a diameter of 100 μm. The number of the particles sampled is 50,000.

The type of the carrier is not limited, and any suitable carrier known in the related art may be used. Examples of the carrier include a coated carrier prepared by coating the surfaces of cores including magnetic powder particles with a resin; a magnetic-powder-dispersed carrier prepared by dispersing and mixing magnetic powder particles in a matrix resin; and a resin-impregnated carrier prepared by impregnating a porous magnetic powder with a resin.

The mixing ratio between the toner and the carrier in the two-component developer is preferably toner:carrier=1:100 to 30:100 by mass and is more preferably 3:100 to 20:100 by mass.

EXAMPLES

The exemplary embodiments are described more specifically with reference to Examples below. The exemplary embodiments are not limited to Examples below.

Hereinafter, "part" and "%" are on a mass basis unless otherwise specified; "PFPE" refers to perfluoropolyether; and "Mw" refers to weight average molecular weight.

Synthesis, treatment, production, and the like are conducted at room temperature (25° C.±3° C.) unless otherwise specified.

Example 1

Preparation of Intermediate Transfer Body

Preparation of Base Layer Forming Liquid Composition

To a N-methyl-2-pyrrolidone solution of polyamic acid produced from 3,3',4,4'-biphenyltetracarboxylic dianhydride and 4,4'-diaminodiphenyl ether (solid component concentration after imide conversion: 18%), 22 parts of carbon black particles "FW200" produced by Orion Engineered Carbons are added relative to 100 parts of solid component produced after imide conversion. The resulting mixture is stirred to form a base layer forming liquid composition.

Preparation of Pipe-like Member Used as Base Layer

An aluminum cylindrical body having an outside diameter of 278 mm and a length of 600 mm is prepared. While the aluminum cylindrical body is rotated, the base layer forming liquid composition is ejected onto a central part of the aluminum cylindrical body which has a width of 500 mm through a dispenser. While the aluminum cylindrical body is kept horizontal, the resulting coating film is dried by heating at 140° C. for 30 minutes. Subsequently, the coating film is heated for 120 minutes such that the maximum temperature is 320° C. Hereby, a polyimide pipe-like member is formed on the aluminum cylindrical body.

Preparation of Surface Layer Forming Liquid Composition

The following materials are mixed and dispersed with a stirrer homogenizer produced by AS ONE Corporation and further dispersed with a dispersing device "Nanomizer" produced by Yoshida Kikai Co., Ltd. to form a dispersion liquid.

Dipentaerythritol hexaacrylate: 8.0 parts

Pentaerythritol tetraacrylate: 17.0 parts

Pentaerythritol triacrylate: 5.0 parts

Methyl ethyl ketone: 43.0 parts

Ethylene glycol: 15.0 parts

Antimony-doped tin oxide particles "SN-100P" produced by Ishihara Sangyo Kaisha, Ltd.: 4.0 parts Photopolymerization initiator "Irgacure 184" produced by BASF SE: 2.0 parts Dispersant "GF-300" produced by Toagosei Co., Ltd. (solid content concentration: 25%): 63.0 parts PFPE "MD700" produced by Solvay Solexis (Mw: 1,700): 21.0 parts Formation of Surface Layer The surface layer forming liquid composition is applied onto the outer peripheral surface of the pipe-like member disposed on the aluminum cylindrical body such that the resulting coating film has a thickness of 4 μm after solidification. The resulting multilayer body is dried by heating at 70° C. for 3 minutes. Subsequently, while the aluminum cylindrical body is rotated, the surface layer is irradiated with ultraviolet radiation emitted from a low- and high-pressure mercury lamp produced by Ushio Inc. (output: 160 W) until the integrated amount of light reaches 500 mJ/cm$^2$ in order to solidify the surface layer. Hereby, an intermediate transfer belt including a surface layer having a thickness of 4 μm is formed.

Preparation of Endless Belt

The multilayer body including the base layer and the surface layer is removed from the aluminum cylindrical body and cut to a width of 363 mm. Hereby, an endless belt that serves as an intermediate transfer body is prepared. The intermediate transfer body has a width of 363 mm. The base layer has a thickness of 80 μm. The surface layer has a thickness of 4 μm.

The surface layer is cut in the thickness direction to prepare a slice sample. The slice sample is observed with a scanning electron microscope. It is confirmed that the surface layer has a sea-island structure.

Preparation of Cleaning Blade

Preparation of Cleaning Blade Main Body

A first polycaprolactone polyol "PLACCEL 205" produced by Daicel Corporation (average molecular weight: 529, hydroxyl value: 212 KOHmg/g) and a second polycaprolactone polyol "PLACCEL 240" produced by Daicel Corporation (average molecular weight: 4,155, hydroxyl value: 27 KOHmg/g) are used as a polyol soft segment material. An acrylic resin "Actflow UMB-2005B" produced by Soken Chemical & Engineering Co., Ltd. which includes two or more hydroxyl groups is used as a hard segment material. The soft and hard segment materials are mixed with each other at a mass ratio of 80:20.

To 100 parts of the resulting mixture of the soft and hard segment materials, 6.26 parts of 4,4'-diphenylmethane diisocyanate "Millionate MT" produced by Nippon Polyurethane Industry Co., Ltd. is added as an isocyanate compound. Subsequently, a reaction is conducted at 70° C. in a nitrogen atmosphere for 3 hours. Then, 34.3 parts of the isocyanate compound is further added to the mixture. Subsequently, a reaction is conducted at 70° C. in a nitrogen atmosphere for 3 hours. Hereby, a prepolymer is formed. The prepolymer is heated to 100° C. and then degassed for 1 hour under reduced pressure. To 100 parts of the prepolymer, 7.14 parts of a mixture of 1,4-butanediol and trimethylolpropane (mass ratio: 60:40) is added. The resulting mixture is stirred to a sufficient degree for 3 minutes such that air bubbles do not enter the mixture. The mixture is then charged into a cleaning blade die to form a cleaning blade main body.

Formation of Tetrahedral Amorphous Carbon Layer

A metal oxide layer (specifically, a titanium oxide layer) that serves as an adhesive layer is formed, by vacuum deposition, on a portion of the cleaning blade main body at which the cleaning blade main body contacts with the intermediate transfer body.

Subsequently, tetrahedral amorphous coating is performed by FCVA, in which carbon plasma is generated by vacuum arc discharge of graphite and ionized carbon is extracted therefrom and deposited, using an FCVA apparatus produced by Shimadzu Corporation. The deposition temperature is set to 40° C. or more and 80° C. or less. The deposition rate is set to 1.5 nm/sec.

The cleaning blade that includes the tetrahedral amorphous carbon layer is bonded to a supporting member made of SUS.

Preparation of Photosensitive Member

Formation of Undercoat Layer

The following materials are mixed with one another. The resulting mixture is stirred and refluxed for 2 hours. The toluene is distilled off under reduced pressure. Then, burn-in is performed at 135° C. for 2 hours. Hereby, zinc oxide surface-modified with a silane coupling agent is prepared.

Zinc oxide "MZ300" produced by Tayca Corporation: 100 parts

Silane coupling agent (10 mass % toluene solution of N-2-(aminoethyl)-3-aminopropyltriethoxysilane): 10 parts Toluene: 200 parts The materials A below are mixed with one another, and the resulting mixture is stirred for 30 minutes. The materials B below are added to the mixture, which is then dispersed with a sand mill for 3 hours. Hereby, a undercoat layer forming coating liquid is prepared. The undercoat layer forming coating liquid is applied onto the outer peripheral surface of an aluminum support having a wall thickness of 1 mm by dip coating. The resulting coating film is cured by drying at 180° C. for 30 minutes to form an undercoat layer having a thickness of 25 μm.

Materials A

Surface-modified zinc oxide: 33 parts

Blocked isocyanate "Sumidur 3175" produced by Sumitomo Bayer Urethane Co., Ltd.: 6 parts The compound represented by Structural Formula (AK-1) below: 1 part Methyl ethyl ketone: 25 parts Materials B Butyral resin "S-LEC BM-1" produced by Sekisui Chemical Co., Ltd.: 5 parts Silicone resin particles "Tospearl 120" produced by Momentive Performance Materials Inc.: 3 parts Leveling agent (silicone oil "SH29PA" produced by Dow Corning Toray Silicone Co., Ltd.): 0.01 parts (AK-1)

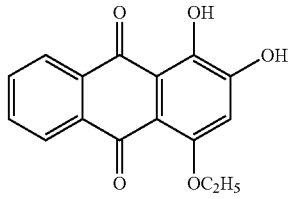

Formation of Charge Generation Layer

The following materials are charged into a glass bottle having a volume of 100 mL together with glass beads having a diameter of 1.0 mm at a filling ratio of 50%. The resulting mixture is dispersed for 2.5 hours with a paint shaker to form a charge generation layer forming coating liquid. The charge generation layer forming coating liquid is applied to the undercoat layer by dip coating. The resulting coating film is dried at 100° C. for 5 minutes to form a charge generation layer having a thickness of 0.20 μm.

Charge generating material: Type-V hydroxygallium phthalocyanine having a diffraction peak at, at least, Bragg angles (20±0.2°) of 7.3°, 16.0°, 24.9°, and 28.0° in an X-ray diffraction spectrum measured with the CuKα radiation, the hydroxygallium phthalocyanine having a maximum peak wavelength at 820 nm in an absorption spectrum that covers a wavelength range of 600 nm or more and 900 nm or less, an average particle diameter of 0.12 μm, a maximum particle diameter of 0.2 μm, and a BET specific surface area of 60 $m^2/g$.

Binder resin: vinyl chloride-vinyl acetate copolymer resin "VMCH" produced by Nippon Unicar Company Limited n-Butyl Acetate The mixing ratio between the hydroxygallium phthalocyanine and the vinyl chloride-vinyl acetate copolymer resin is set to 55:45 by volume. The solid content in the charge generation layer forming coating liquid is set to 6% by mass. In the calculation of the volume fractions, the specific gravity of the hydroxygallium phthalocyanine is considered 1.606 $g/cm^3$, and the specific gravity of the vinyl chloride-vinyl acetate copolymer resin is considered 1.35 $g/cm^3$.

Formation of Charge Transport Layer

The following materials are mixed with one another to form a charge transport layer forming coating liquid. The charge transport layer forming coating liquid is applied to the charge generation layer by dip coating. The resulting coating film is dried at 150° C. for 40 minutes to form a charge transport layer having a thickness of 34 μm. A photosensitive member is prepared by the above-described steps.

Binder resin: the bisphenol polycarbonate resin represented by Structural Formula (PC-1) below (polymerization ratio of structural units: 25:75, viscosity average molecular weight: 50,000): 60 parts Butadiene charge transporting material: the compound represented by Structural Formula (CT1A) below: 8 parts Benzidine charge transporting material: the compound represented by Structural Formula (CT2A) below: 32 parts Tetrafluoroethylene resin particles (volume average particle size: 200 nm): 8 parts Fluorine-containing dispersant "GF400" produced by Toagosei Co., Ltd.: 0.3 parts Hindered phenol antioxidant (the compound represented by Structural Formula (HP-1) below): 3.2 parts Tetrahydrofuran: 340 parts Setting of Image Forming Apparatus The intermediate transfer body, the intermediate transfer body cleaning blade, and the photosensitive member are attached to an electrophotographic image forming apparatus "Versant 180 Press" produced by Fuji Xerox Co., Ltd. Furthermore, a rotary brush including conductive fibers arranged in a cylindrical form and a feed mechanism that feeds zinc stearate onto the surface of the intermediate (PC-1)

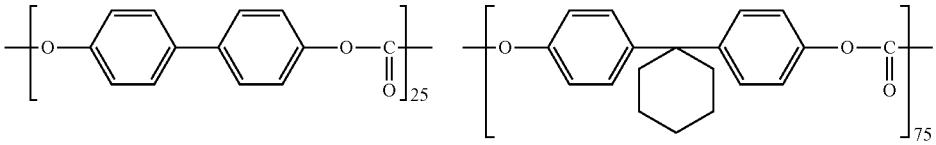

(CT1A)

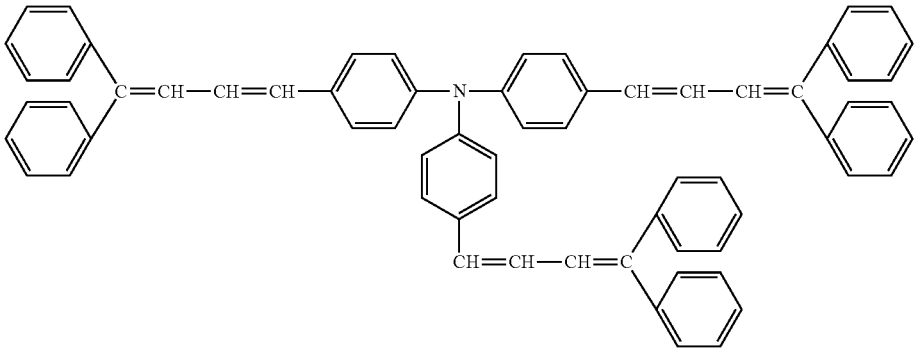

(CT2A)

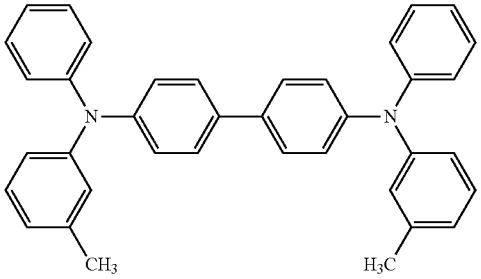

(HP-1)

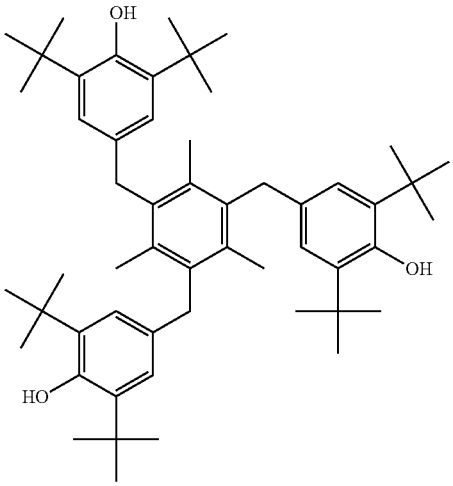

transfer body are attached to the intermediate transfer body cleaning device of the image forming apparatus.

The linear velocities of the intermediate transfer body, the photosensitive member, and the second transfer unit are set as described in Table 1. The amount of toner retained by the rotary brush including conductive fibers arranged in a cylindrical form is set as described in Table 1.

A cyan developer (volume average particle size of toner: 5.8 μm), a magenta developer (volume average particle size of toner: 5.8 μm), a yellow developer (volume average particle size of toner: 5.8 μm), and a black developer (volume average particle size of toner: 5.8 μm) which are produced by Fuji Xerox Co., Ltd. are charged into a developing device of the image forming apparatus.

Evaluation of Transfer Inconsistencies

At a temperature of 28° C. and a relative humidity of 85%, a halftone image having an area coverage of 5% is formed on 20,000 A4-size woodfree paper sheets "C2 paper" produced by Fuji Xerox Co., Ltd. Subsequently, a black solid image is formed on a A3-size embossed paper sheet "LEATHAC 66" produced by Tokushu Tokai Paper Co., Ltd. (ream weight: 175 kg). The paper sheet is visually inspected for the presence of image missing and classified as follows.

G1: Image missing is absent all over the A3-size sheet
G2: Image missing is present at 2 or less positions
G3: Image missing is present at 5 or less positions
G4: Image missing is present all over the A3-size sheet Examples 2 to 5 and Comparative Examples 1 to 4

An image forming apparatus is set as in Example 1, except that the linear velocities of the intermediate transfer body, the photosensitive member, and the second transfer unit and the amount of toner retained in the rotary brush that includes conductive fibers arranged in a cylindrical form are changed as described in Table 1. The image forming apparatus is evaluated in terms of transfer inconsistencies.

TABLE 1

| | Linear velocity | | | | | Amount of toner | |
|---|---|---|---|---|---|---|---|
| | Intermediate transfer body mm/sec | Photosensitive member mm/sec | Second transfer unit mm/sec | Requirement (1) — | Requirement (2) — | retained in rotary brush g/m$^2$ | Transfer inconsistencies |
| Example 1 | 536 | 528 | 543 | 1.49 | 1.31 | 2.0 | G1 |
| Example 2 | 536 | 528 | 538 | 1.49 | 0.37 | 2.0 | G2 |
| Example 3 | 530 | 528 | 537 | 0.38 | 1.32 | 2.0 | G2 |
| Example 4 | 530 | 528 | 532 | 0.38 | 0.38 | 2.0 | G3 |
| Example 5 | 530 | 528 | 532 | 0.38 | 0.38 | 3.8 | G1 |
| Comparative Example 1 | 528 | 528 | 528 | 0.00 | 0.00 | 0.5 | G4 |
| Comparative Example 2 | 528 | 528 | 543 | 0.00 | 2.84 | 0.5 | G4 |
| Comparative Example 3 | 543 | 528 | 543 | 2.76 | 0.00 | 0.5 | G4 |
| Comparative Example 4 | 543 | 528 | 558 | 2.76 | 2.76 | 0.5 | G4 |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a photosensitive member;

a charging unit that charges a surface of the photosensitive member;

an electrostatic image formation unit that forms an electrostatic image on the charged surface of the photosensitive member;

a developing unit that includes a developer including a toner and develops the electrostatic image formed on the surface of the photosensitive member with the developer to form a toner image;

an intermediate transfer body including a surface layer, the surface layer including an acrylic resin and a fluorine-containing polyether;

a first transfer unit that transfers the toner image onto a surface of the intermediate transfer body as first transfer;

a second transfer unit that transfers the toner image transferred on the surface of the intermediate transfer body to a recording medium as second transfer; and an intermediate transfer body cleaning unit that includes a cleaning blade including a tetrahedral amorphous carbon layer disposed on a surface of a contact portion of the cleaning blade, the contact portion being arranged to contact with the intermediate transfer body, and removes a residual toner by bringing the cleaning blade into contact with the intermediate transfer body, wherein linear velocities of the intermediate transfer body and the photosensitive member are adjusted to satisfy a requirement (1) below:

$$0.3 \leq |\text{Linear velocity of Intermediate transfer body} - \text{Linear velocity of Photosensitive member}| / \text{Linear velocity of Intermediate transfer body} \times 100 \leq 1.5 \quad \text{Requirement (1).}$$

2. The image forming apparatus according to claim 1, wherein the linear velocity of the intermediate transfer body and a linear velocity of the second transfer unit are adjusted to satisfy a requirement (2) below:

$$0.3 \leq |\text{Linear velocity of Intermediate transfer body} - \text{Linear velocity of Second transfer unit}| / \text{Linear velocity of Intermediate transfer body} \times 100 \leq 1.5 \quad \text{Requirement (2).}$$

3. The image forming apparatus according to claim 2, wherein the requirement (1) is a requirement (1') below:

$$0.5 \leq |\text{Linear velocity of Intermediate transfer body} - \text{Linear velocity of Photosensitive member}| / \text{Linear velocity of Intermediate transfer body} \times 100 \leq 1.2 \quad \text{Requirement (1').}$$

4. The image forming apparatus according to claim 2, wherein the requirement (2) is a requirement (2') below:

$$0.5 \leq |\text{Linear velocity of Intermediate transfer body} - \text{Linear velocity of Second transfer unit}| / \text{Linear velocity of Intermediate transfer body} \times 100 \leq 1.5 \quad \text{Requirement (2').}$$

5. The image forming apparatus according to claim 2, wherein the surface layer of the intermediate transfer body includes a sea-island structure, and wherein the sea-island structure includes a sea phase and an island phase, the sea phase including the acrylic resin, the island phase including the fluorine-containing polyether.

6. The image forming apparatus according to claim 1, wherein the requirement (1) is a requirement (1') below:

$$0.5 \leq |\text{Linear velocity of Intermediate transfer body} - \text{Linear velocity of Photosensitive member}| / \text{Linear velocity of Intermediate transfer body} \times 100 \leq 1.2 \quad \text{Requirement (1')}.$$

7. The image forming apparatus according to claim 6, wherein the surface layer of the intermediate transfer body includes a sea-island structure, and wherein the sea-island structure includes a sea phase and an island phase, the sea phase including the acrylic resin, the island phase including the fluorine-containing polyether.

8. The image forming apparatus according to claim 1, wherein the surface layer of the intermediate transfer body includes a sea-island structure, and wherein the sea-island structure includes a sea phase and an island phase, the sea phase including the acrylic resin, the island phase including the fluorine-containing polyether.

9. The image forming apparatus according to claim 1, wherein the fluorine-containing polyether includes a perfluoropolyether.

10. The image forming apparatus according to claim 1, wherein the intermediate transfer body cleaning unit further includes a rotary brush including conductive fibers arranged in a cylindrical form, and wherein an amount of toner retained on an outer peripheral surface of the rotary brush is adjusted to be 1.0 $g/m^2$ or more and 4.0 $g/m^2$ or less.

11. The image forming apparatus according to claim 1, wherein the toner has a volume average particle size of 7.0 μm or less.

12. The image forming apparatus according to claim 11, wherein the toner has a volume average particle size of 5.8 μm or less.

13. An image forming apparatus comprising:

a photosensitive member;

a charging unit that charges a surface of the photosensitive member;

an electrostatic image formation unit that forms an electrostatic image on the charged surface of the photosensitive member;

a developing unit that includes a developer including a toner and develops the electrostatic image formed on the surface of the photosensitive member with the developer to form a toner image;

an intermediate transfer body including a surface layer, the surface layer including an acrylic resin and a fluorine-containing polyether;

a first transfer unit that transfers the toner image onto a surface of the intermediate transfer body as first transfer;

a second transfer unit that transfers the toner image transferred on the surface of the intermediate transfer body to a recording medium as second transfer; and an intermediate transfer body cleaning unit that includes a cleaning blade including a tetrahedral amorphous carbon layer disposed on a surface of a contact portion of the cleaning blade, the contact portion being arranged to contact with the intermediate transfer body, and removes a residual toner by bringing the cleaning blade into contact with the intermediate transfer body, wherein linear velocities of the intermediate transfer body and the second transfer unit are adjusted to satisfy a requirement (2) below:

$$0.3 \leq |\text{Linear velocity of Intermediate transfer body} - \text{Linear velocity of Second transfer unit}| / \text{Linear velocity of Intermediate transfer body} \times 100 \leq 1.5 \quad \text{Requirement (2)}.$$

14. The image forming apparatus according to claim 13, wherein the linear velocity of the intermediate transfer body and a linear velocity of the photosensitive member are adjusted to satisfy a requirement (1) below:

$$0.3 \leq |\text{Linear velocity of Intermediate transfer body} - \text{Linear velocity of Photosensitive member}| / \text{Linear velocity of Intermediate transfer body} \times 100 \leq 1.5 \quad \text{Requirement (1)}.$$

15. The image forming apparatus according to claim 14, wherein the requirement (1) is a requirement (1') below:

$$0.5 \leq |\text{Linear velocity of Intermediate transfer body} - \text{Linear velocity of Photosensitive member}| / \text{Linear velocity of Intermediate transfer body} \times 100 \leq 1.2 \quad \text{Requirement (1')}.$$

16. The image forming apparatus according to claim 14, wherein the requirement (2) is a requirement (2') below:

$$0.5 \leq |\text{Linear velocity of Intermediate transfer body} - \text{Linear velocity of Second transfer unit}| / \text{Linear velocity of Intermediate transfer body} \times 100 \leq 1.5 \quad \text{Requirement (2')}.$$

17. The image forming apparatus according to claim 14, wherein the surface layer of the intermediate transfer body includes a sea-island structure, and wherein the sea-island structure includes a sea phase and an island phase, the sea phase including the acrylic resin, the island phase including the fluorine-containing polyether.

18. The image forming apparatus according to claim 13, wherein the requirement (2) is a requirement (2') below:

$$0.5 \leq |\text{Linear velocity of Intermediate transfer body} - \text{Linear velocity of Second transfer unit}| / \text{Linear velocity of Intermediate transfer body} \times 100 \leq 1.5 \quad \text{Requirement (2')}.$$

19. The image forming apparatus according to claim 13, wherein the surface layer of the intermediate transfer body includes a sea-island structure, and wherein the sea-island structure includes a sea phase and an island phase, the sea phase including the acrylic resin, the island phase including the fluorine-containing polyether.

20. An intermediate transfer unit comprising:

an intermediate transfer body including a surface layer, the surface layer including an acrylic resin and a fluorine-containing polyether; and an intermediate transfer body cleaning unit that includes a cleaning blade including a tetrahedral amorphous carbon layer disposed on a surface of a contact portion of the cleaning blade, the contact portion being arranged to contact with the intermediate transfer body, and removes a residual toner by bringing the cleaning blade into contact with the intermediate transfer body.

* * * * *